US005554036A

United States Patent [19]

Shirai et al.

[11] Patent Number: 5,554,036

[45] Date of Patent: Sep. 10, 1996

[54] CIRCUIT BOARD ELECTRICAL CONNECTOR

[75] Inventors: Hiroshi Shirai, Saitama; Okitsugu Furuya, Tokyo; Takaki Naitoh, Inagi, all of Japan

[73] Assignee: The Whitaker Corporation, Wilmington, Del.

[21] Appl. No.: 458,068

[22] Filed: Jun. 1, 1995

[30] Foreign Application Priority Data

Jul. 4, 1994 [JP] Japan ..... 6-174742

[51] Int. Cl.[6] ..... H01R 9/09; H01R 23/68

[52] U.S. Cl. ..... 439/74; 439/66; 439/67; 439/660

[58] Field of Search ..... 439/62, 66, 67, 439/74, 660

[56] References Cited

U.S. PATENT DOCUMENTS

| | | | |
|---|---|---|---|
| 4,517,625 | 5/1985 | Frink et al. | 439/67 |
| 4,636,018 | 1/1987 | Stillie . | |
| 4,655,519 | 4/1987 | Evans et al. | 439/74 |
| 4,693,530 | 9/1987 | Stillie et al. | 439/67 |
| 4,798,541 | 1/1989 | Porter | 439/67 |
| 5,026,290 | 6/1991 | Dery | 439/67 |
| 5,035,628 | 7/1991 | Casciotti et al. | 439/66 |
| 5,049,084 | 9/1991 | Bakke | 439/74 |
| 5,102,343 | 4/1992 | Knight et al. | 439/67 |
| 5,145,381 | 9/1992 | Volz | 439/62 |
| 5,147,207 | 9/1992 | Mowry | 439/74 |
| 5,199,884 | 4/1993 | Kaufman et al. | 439/74 |
| 5,228,862 | 7/1993 | Baumberger et al. | 439/66 |
| 5,259,770 | 11/1993 | Bates et al. | 439/67 |
| 5,277,593 | 1/1994 | Bates et al. | 439/66 |
| 5,299,939 | 4/1994 | Walker et al. | 439/74 |
| 5,345,366 | 9/1994 | Cheng et al. | 439/74 |
| 5,360,347 | 11/1994 | Irlbeck et al. | 439/66 |
| 5,427,535 | 6/1995 | Sinclair | 439/67 |
| 5,474,458 | 12/1995 | Vafi et al. | 439/66 |

OTHER PUBLICATIONS

Ampliflex Connector Centerline & Alignment Chart Copyright 1993 by AMP Incorporated.

Ampliflex Surface Mount Connectors Copyright 1985 & 1991 by AMP Incorporated.

*Primary Examiner*—Gary E. Elkins

[57] ABSTRACT

A circuit board connector 110, 210 for electrically connecting conductive pads 261,262 of circuit boards 260*a*,260*b* comprises a first dielectric housing 120*a*, 220*a* having a recess 141,241 extending along the length thereof, first electrical contacts 150*a*, 250*a* on the first dielectric housing 120*a*,220*a* having first contact sections for electrical connection to the conductive pads 261 of a first circuit board 260*a* and second contact sections extending along opposing walls of the recess 141,241; a second dielectric housing 120*b*, 220*b* profiled to fit within the recesses 141, 241, second electrical contacts 150*b*, 250*b* on the second dielectric housing 120*b*, 220*b* having third contact sections for electrical connection to the conductive pads 262 of a second circuit board 260*b* and fourth contact sections extending along side surfaces of the second dielectric housing 120*b*, 220*b* opposite the walls of the recess 141, 241; and elastomer connecting members 30 disposed in the recess 141, 241 between the side surfaces of the second dielectric housing 120*b*, 220*b* and the walls of the recess 141, 241 electrically connecting the second contact sections and the fourth contact sections.

6 Claims, 5 Drawing Sheets

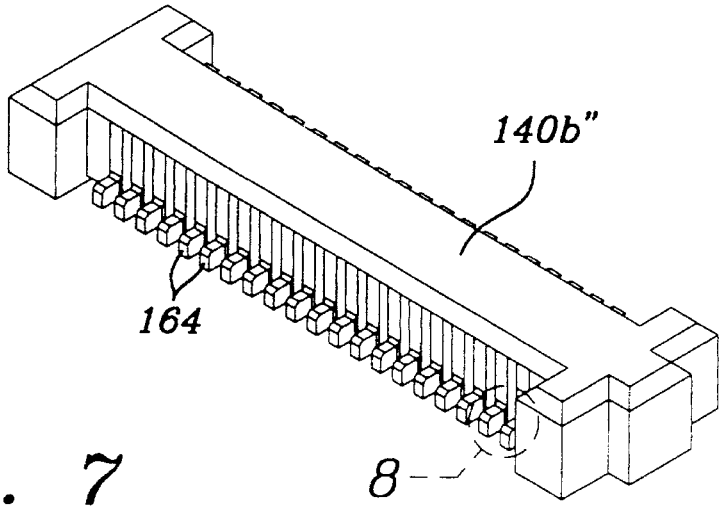
FIG. 7
FIG. 8
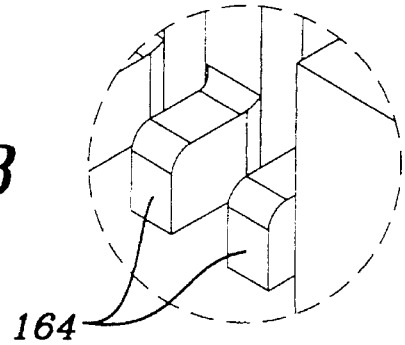
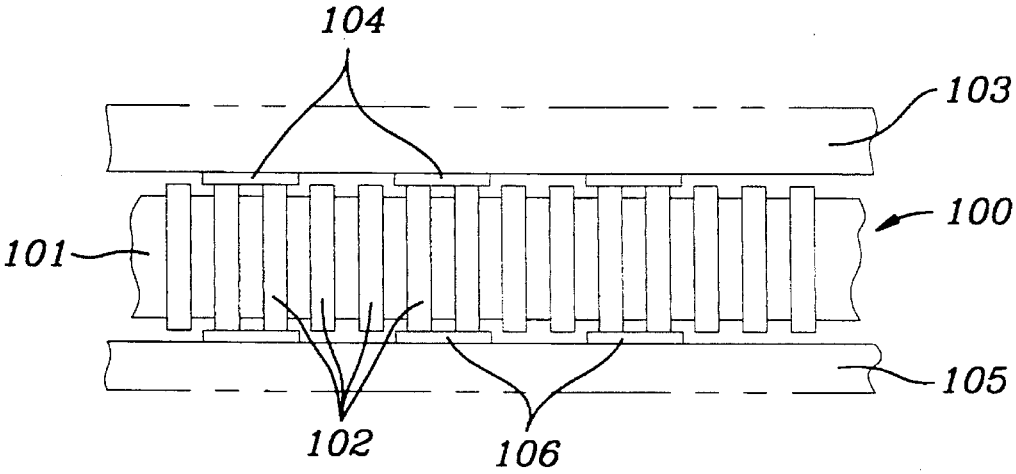
FIG. 14

CIRCUIT BOARD ELECTRICAL CONNECTOR

FIELD OF THE INVENTION

The present invention concerns an electrical connector, especially a board connector which connects the respective conductive pads of substrates or circuit boards each having a plurality of the pads.

BACKGROUND OF THE INVENTION

As a result of the thin-film miniaturization of electronic devices, the packaging density of recent electronic devices has increased tremendously. Various types of board connectors which connect pairs of boards have been proposed and adapted for practical use in order to increase the packaging density of electronic circuits.

One example of a board connector with a low-back structure which connects the respective conductive pads of a pair of boards installed parallel to each other with each of the boards having a plurality of pads on inside surfaces (i.e., surface facing the surface of the other board) is an elastomer connector marketed under the trademark of AMPLIFLEX by AMP Incorporated of Harrisburg, Pa., U.S.A. (as shown in FIG. 14). Furthermore, another example of an elastomer connector is disclosed in Japanese Patent Publication No. 61-284078.

As is shown in FIG. 14, a conventional elastomer connector 100 has high-density ring-shaped conductive layers 102 disposed at fixed intervals on the outer circumference of a rod-shaped core 101 of elastomer (insulating elastic member) such as silicone rubber, etc. Such an elastomer connector is inserted and compressed between first and second circuit boards 103 and 105, each of which has a plurality of conductive pads 104 and 106 formed in a linear shape on its inside surface. Specifically, when the two boards 103 and 105 are pressed together with the pads 104 and 106 aligned, the elastomer core 101 of the elastomer connector 100 is deformed so that the corresponding pads 104 and 106 are connected to each other by one or more conductive layers 102.

However, in such a conventional board connector or elastomer connector 100, the boards are directly connected, with the elastomer connector 100 being compressively deformed by the application of a large pressure to the boards 103 and 105, so that the conductive layers 102 on the outer circumference of the connector are pressed against the pads 104 and 106. Accordingly, no wiping action is generated, so that it is difficult to obtain highly reliable connections. Especially in cases where warping occurs as a result of the pressing of the boards 103 and 105, it becomes impossible to connect all of the pads correctly and with high reliability.

In order to prevent such warping of the boards 103 and 105, it is necessary to fasten the boards 103 and 105 together by means of a plurality of fastening devices such as screws, etc., installed along the pads 104 and 106 of the boards 103 and 105, so that the gap between the boards is maintained at a more or less constant value. However, as the number of fastening screws is increased, the number of pads that can be formed becomes limited; furthermore, the efficiency of assembly of the connection drops conspicuously.

Furthermore, the thickness of the boards themselves may be increased so that the strength of the boards is increased, or reinforcing plates may be used on the outside of the mutually connected parts of the boards, in order to prevent or reduce warping of the boards. However, when thick boards or reinforcing plates are used, the overall thickness of the mutually connected devices is increased, so that the packaging density drops.

Accordingly, the object of the present invention is to provide a novel board connector which does not require the application of a large pressing force to the mutually connected boards so that warping of the boards is prevented, and which offers a high packaging density and high reliability by means of a low-cost structure without using any reinforcing plates, etc.

SUMMARY OF THE INVENTION

The board connector of the present invention is a board connector connecting the respective conductive pads of first and second boards, each having a plurality of pads wherein the board connector is equipped with a first housing which is attached to a first board, the first housing having a plurality of first contacts which are connected to the conductive pads, and a recess which extends in the direction of the length of the housing; a second housing is attached to a second board, the second housing having a plurality of second contacts which are connected to the conductive pads, and being accommodated inside the recess of the first housing; elastomer connecting members are inserted into the recess of the first housing in which the second housing is accommodated which connect contact sections of the first and second contacts to each other; and at least the first contacts or the second contacts are plating layers formed on a surface of the corresponding housing.

Furthermore, the board connector of the present invention is also a board connector connecting the respective conductive pads of first and second boards, each having a plurality of conductive pads wherein the board connector is equipped with a first housing which is attached to the first board, the first housing having a plurality of first contacts which are connected to the conductive pads, and a recess which is extends in the direction of the length of the housing; a second housing is attached to the second board, the second housing having a plurality of second contacts which are connected to the conductive pads, and being accommodated inside the recess of the first housing; elastomer connecting members are inserted into the recess of the first housing in which the second housing is accommodated which connect contact sections of the first and second contacts to each other; and at least the first contacts or the second contacts comprise conductive patterns on a flexible printed circuit installed along an outside surface of the corresponding housing.

In addition, the board connector of the present invention is also a board connector connecting the respective conductive pads of first and second boards, each having a plurality of conductive pads wherein the connector is equipped with a first housing which is attached to the first board, the first housing having a plurality of first contacts which are connected to the conductive pads, and a recess which extends in the direction of the length of the housing; a second housing is attached to the second board, the second housing having a plurality of second contacts which are connected to the conductive pads, and being accommodated inside the recess of the first housing; elastomer connecting members are inserted into the recess of the first housing in which the second housing is accommodated which connect the contact sections of the first and second contacts to each other; the first contacts comprise conductive patterns on a flexible printed circuit installed along the outside surface of the first housing; and the second contacts comprise plating layers formed on the surface of the second housing.

BRIEF DESCRIPTION OF THE DRAWINGS

Embodiments of the board connector of the present invention will now be described by way of example with reference to the accompanying drawings in which:

FIG. 7 is a perspective view of another embodiment of the board connector of FIG. 1.

FIG. 8 is a past perspective view of area B of FIG. 7.

FIG. 14 is a front view of a conventional elastomer connector installed between a pair of circuit boards.

DETAILED DESCRIPTION OF THE INVENTION

Figure 1:
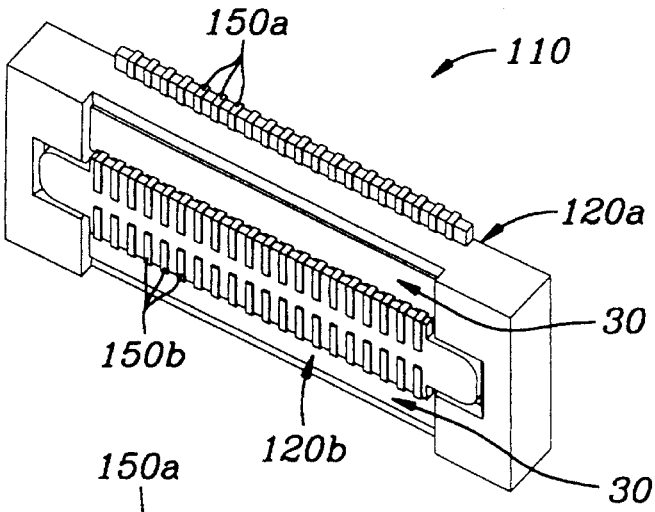
FIG. 1 is a perspective view of a circuit board connector of the present invention.
Figure 2:
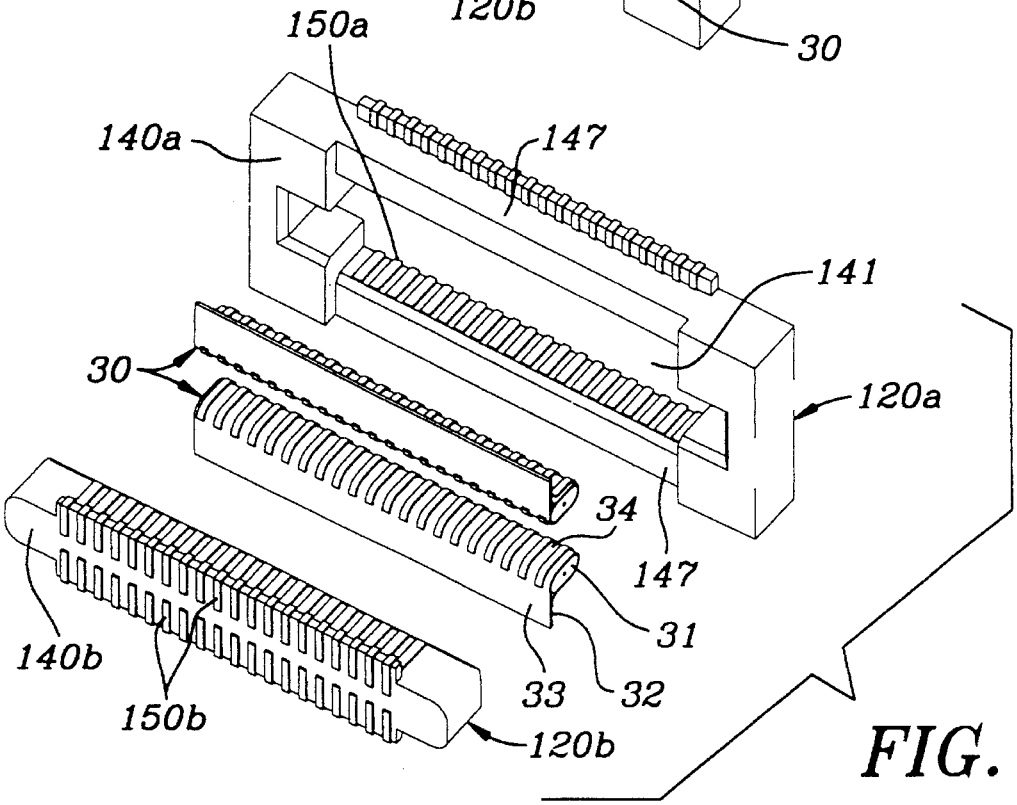
FIG. 2 is an exploded perspective view of the parts of the connector of FIG. 1.
Figure 3:
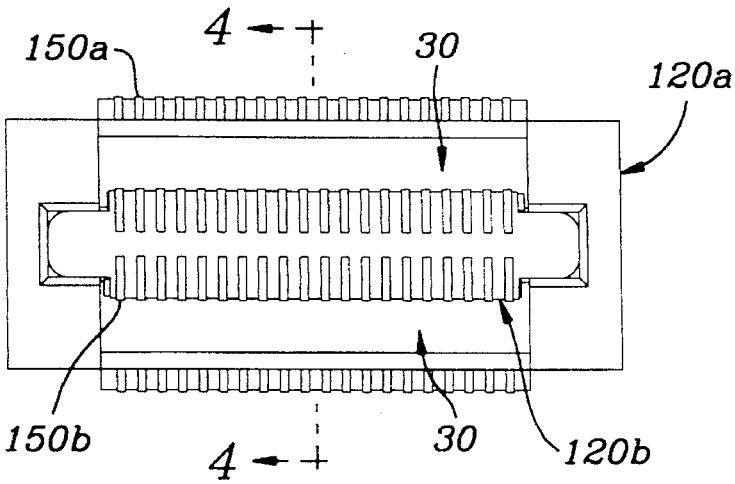
FIG. 3 is a front view of the connector of FIG. 1.
Figure 4:
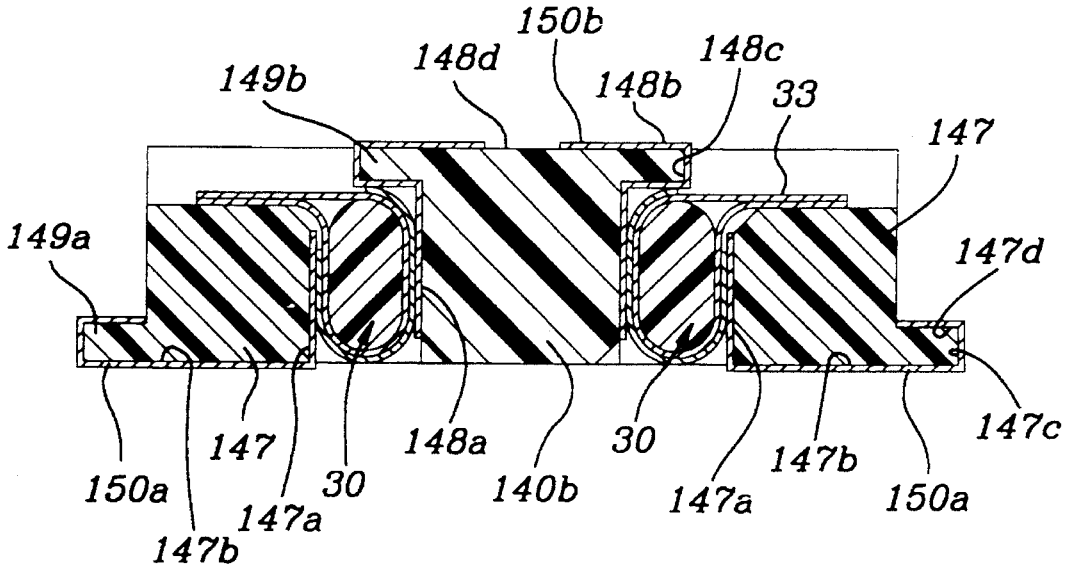
FIG. 4 is a cross-sectioned view taken along line 4—4 of FIG. 3.

The board connector 110 of the present invention comprises a first connector 120*a* and a second connector 120*b*, each of which has respective contacts 150*b*, 150*b* arranged in two rows, and two elastomer connecting members 30. The first housing 140*a* of the first connector 120*a* has a recess 141, preferably with an asymmetrical shape formed along its direction of length. A plurality of contacts 150*a* are located parallel to each other on the respective outer surfaces of two long, slender bridge parts 147 which extend parallel to each other on either side of the recess 141; i.e., contacts 150*a* extend over the inside surfaces 147*a*, bottom surfaces 147*b* and outside surfaces 147*c* and 147*d* of the bridge parts 147 (FIG. 4). Similarly, in the case of the second connector 120*b*, contacts 150*b* separated into two rows are located on the outer surface of the second housing 140*b*; i.e., contacts 150*b* extend over the side surfaces 148*a*, outside surfaces 148*b* and 148*c* and bottom surface 148*d* of second housing 140*b*.

When the second connector 120*b* is inserted or positioned in the recess 141 of the first housing 140*a* of the first connector 120*a* with the pair of elastomer connecting members 30, interposed on both sides of second connector 120*b*, the contact sections on surfaces 147*a* and 148*a* of the two rows of facing contacts 150*a* and 150*b* are connected to each other by the respective elastomer connecting members 30. As a result, the two rows of contacts 150*a* and 150*b* of the first and second connectors 120*a* and 120*b*, which are respectively connected by SMT soldering to two rows of conductive pads on the facing surfaces of two boards (not shown) facing each other, are electrically connected by the respective elastomer connecting members 30. Furthermore, in the board connector 110, high-density connections are achieved by using two rows of contacts 150*a*; however, it would also be possible to use a single row of contacts or three or more rows of contacts.

The elastomer connecting members 30 may have a structure which is substantially similar to that of the conventional elastomer connector 100 shown in FIG. 14. Specifically, in each connecting member 30, numerous conductive paths are formed parallel to each other at a high density on the outer circumference of an elastomer core 31 which is roughly elliptical or oval in cross section. In the present embodiment, instead of forming the conductive paths directly on the outer circumference of the elastomer core 31, a flexible printed circuit (FPC) 32 which has numerous conductive paths formed on its outside surface by a universally known printing or etching method, etc., is wrapped around the core 31, and the end parts of FPC 32 are caused to extend outward at one end of the core 31 (the upper end in FIG. 4) so that a retaining part 33 is formed. It is desirable that the pitch of the conductors 34 on each FPC 32 be approximately one fifth the pitch of the contacts 150*a* and 150*b*. For example, in a case where the pitch of the contacts 150*a* and 150*b* is 0.5 mm, it is desirable that the pitch of the conductors 34 be 0.1 mm. The elastomer connecting members 30 are only in compressive contact inside the telescoping first and second connectors 120*a* and 120*b* in the direction parallel to the surfaces of the boards. Accordingly, no direct compressive force acts in the perpendicular direction on the two boards which are installed parallel to each other, so that there is no danger that the boards will be warped.

The contacts 150*a* and 150*b* of the board connector 110 are formed using the so-called "molded interconnection device" (hereafter abbreviated to "MID") method, in which a conductive pattern is formed three-dimensionally on the surface of an insulating plastic by electroless plating or electroplating using an additive process, etc. It is desirable that the plating thickness of the contacts 150*a* and 150*b* be approximately 20 microns. The two main types of conductor formation by MID are known as the one-shot molding process and the two-shot molding process. In the one-shot molding process, the surface of the insulating plastic is coated with a plating resist or etching resist, and a conductive pattern is formed by a photolithographic process (see Japanese Patent Publication No. 61-113295). Meanwhile, in the case of the two-shot molding process, double molding is performed using two types of material, i.e., a platable plastic and a non-platable plastic, and a conductive pattern is formed only on the surface of the platable plastic (see Japanese Patent Publication No. 63-50482). Due to lower mold costs, etc., it is desirable that the one-shot molding process be used for the molding of the contacts 150*a* and 150*b*; however, the two-shot molding process may also be used.

In an embodiment disclosed in Japanese Patent Publication No. 6-36551, metal contacts formed by a pressing process were press-fitted or insert-molded in a housing. In this case, however, difficulties were encountered in obtaining pitch values smaller than 1 to 1.5 mm, and there were also problems in terms of unevenness of the positions of the connecting parts connected to the boards (low flatness), etc. In the present board connector 110, on the other hand, the contacts 150*a* and 150*b* are formed by MID. As a result, the following technical advantages are obtained: i.e., contacts with a narrow pitch, which are difficult to realize in the case of a pressing process, can be obtained; furthermore, since there is no need for the contacts to have parts used for fastening to the housing, a reduction of the area occupied by the board can be achieved, and a high flatness can be obtained in the parts used for connection to the respective boards. Moreover, the dimensional precision is high even in the case of numerous contacts. In addition, since there is no need for a contact mold or an assembler to insert the contacts into the housings, etc., the number of parts is greatly reduced, so that the economic advantage of a lower overall manufacturing cost is obtained.

Figure 5:
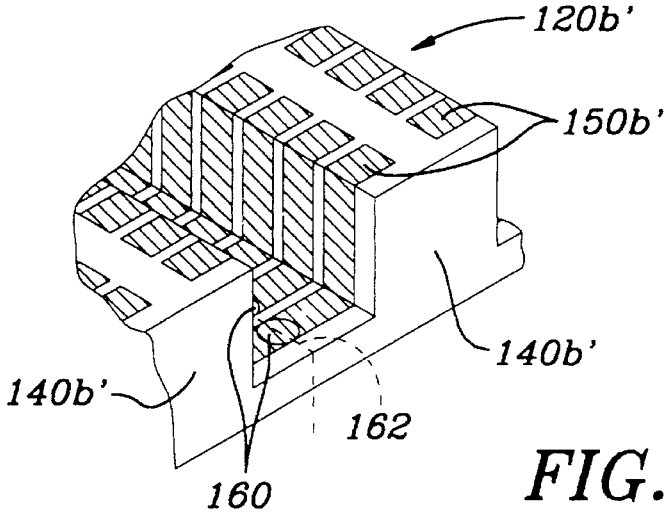
FIG. 5 is a part perspective view of an embodiment of the board connector of FIG. 1 prior to cutting.
Figure 6:
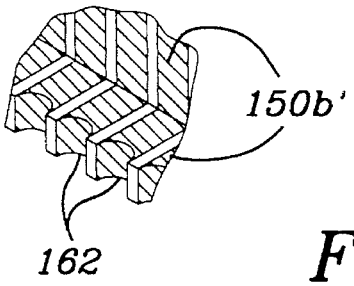
FIG. 6 is an enlarged part perspective view of the connector of FIG. 5 after cutting.

Furthermore, the parts of the first and second connectors 120*a* and 120*b* that are connected to the boards are complicated, with a structure obtained by forming a conductive pattern on the surfaces of protruding parts 149*a* and 149*b* which protrude from the side surfaces of the first and second housings 140*a* and 140*b*. In cases where numerous units are formed by MID, low cost can be achieved by cutting a single large plate-form body or right-angled parallelepiped using a dicing saw, etc. For example, as is shown in FIG. 5, a low-cost second connector 120*b* can be obtained by boring through-holes 160 through a body comprising a multiple number of connected second housings 140*b*', forming contacts 150*b*' by MID, and then cutting the body along the broken line 162 shown in FIG. 5, which passes through the approximate centers of the through-holes 160. Alternatively, it would also be possible to form a conductive pattern on the surfaces of lead forms 164 which resemble the teeth of a comb as shown in FIGS. 7 and 8, or on flat surfaces which have no protruding parts 149*a* or 149*b*.

Figure 9:
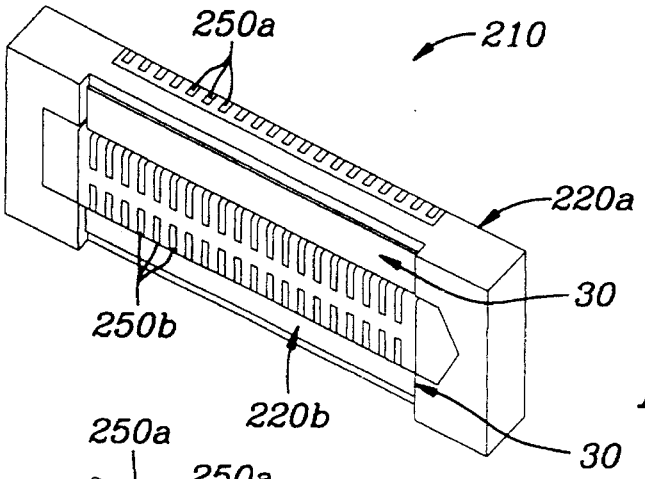
FIG. 9 is a perspective view of a further embodiment of the board connector.
Figure 10:
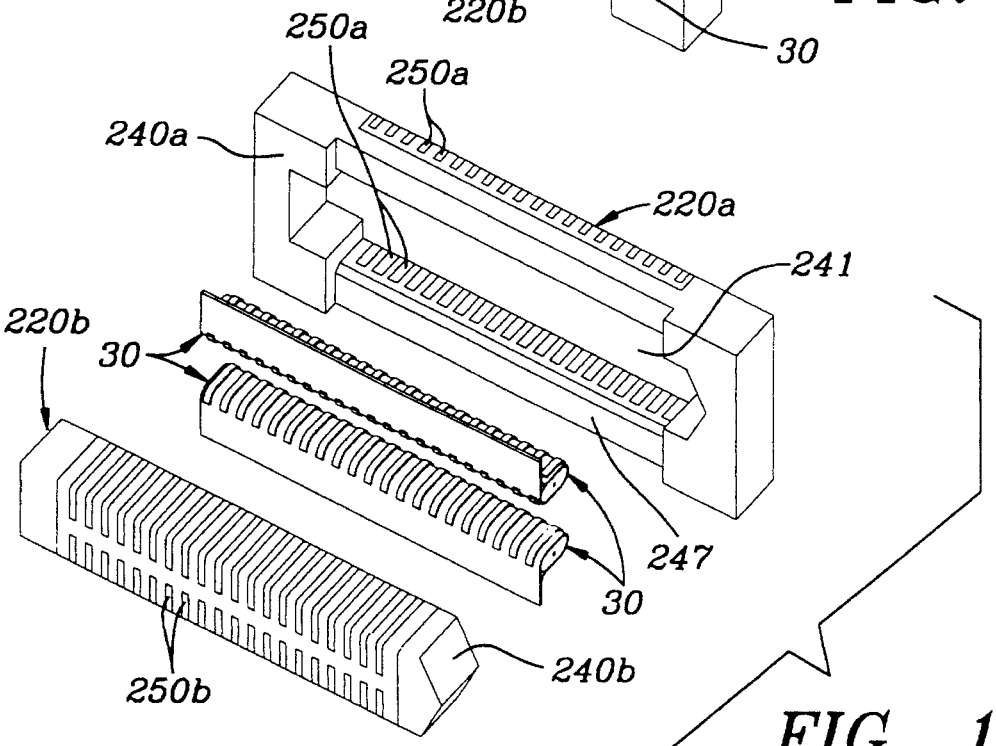
FIG. 10 is a perspective exploded view of the parts of the connector of FIG. 9.
Figure 11:
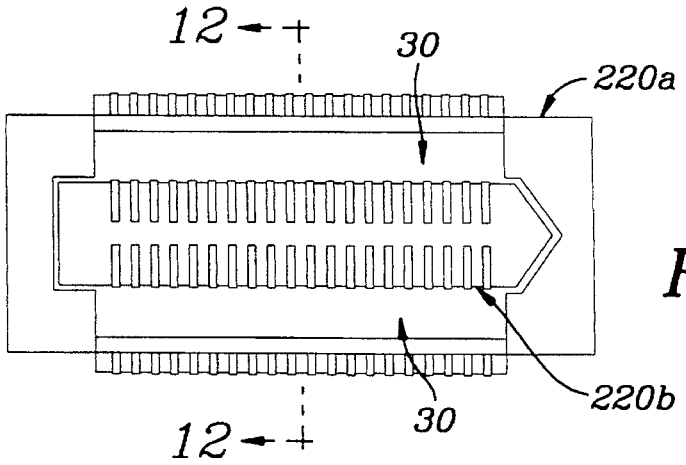
FIG. 11 is a front view of the connector of FIG. 9.
Figure 12:
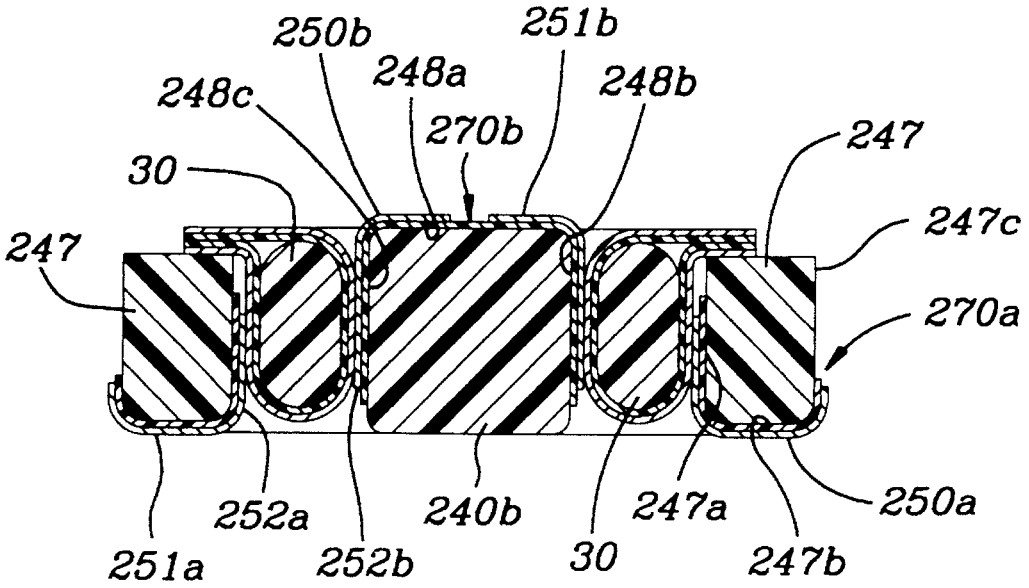
FIG. 12 is a cross-sectional view taken along line 12—12 of FIG. 11.
Figure 13:
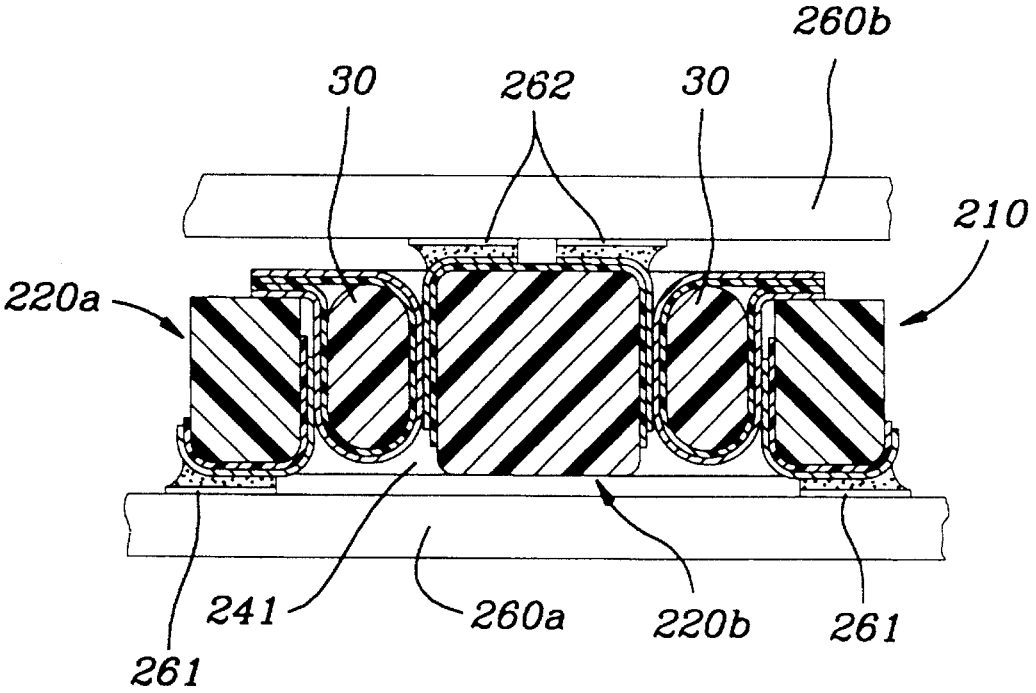
FIG. 13 is a view similar to FIG. 12 showing the board connector of FIG. 9 solder connected to parallel circuit boards.

FIG. 9 illustrates another embodiment of the board connector of the present invention. The board connector 210 of this embodiment is similar to that of the above embodiment in that it comprises a first connector 220*a*, a second connector 220*b*, and elastomer connecting members 30. The first connector 220*a* is covered by a first FPC (flexible printed circuit) 270*a* which extends across the inside surfaces 247*a*, bottom surfaces 247*b* and outside surfaces 247*c* of the two long, slender bridge parts 247, of the first housing 240*a*. Similarly, the second connector 220*b* is covered by a second FPC 270*b* which extends across three surfaces of the second housing 240*b*, i.e., the bottom surface 248*a* and both sides surfaces 248*b* and 248*c*. A plurality of conductive patterns 250*a* and 250*b* are formed parallel to each other on the respective FPC 270*a* and 270*b*. These conductive patterns 250*a* and 250*b* form the respective contacts of the first and second connectors 220*a* and 220*b*. Furthermore, it would also be possible to wrap the FPC 270*a* and 270*b* around the entire periphery of each of the bridge parts 247 and the second housing 240*b*. The solder connection parts 251*a* and 251*b* of the respective conductive patterns 250*a* and 250*b* are respectively soldered to the conductive pads 261 and 262 of boards 260*a* and 260*b* (FIG. 13).

In the FPC 270*a* and 270*b*, the conductive patterns 250*a* and 250*b* can be formed by an ordinary FPC manufacturing process, i.e., by a photolithographic process on a flat surface. Accordingly, although the pitch of the conductive patterns 250*a* and 250*b* in the connector 210 of the embodiment of FIGS. 9–13 is 0.5 mm, the pitch can be made even narrower if necessary. Furthermore, since a photolithographic process on a flat surface is used, the width (or pitch) of the conductive patterns 250*a* and 250*b* on the same flat surface can easily be made different between the contact parts 252*a* and 252*b* which contact the elastomer connecting members 30, and the solder connection parts 251*a* and 251*b* which are connected to the boards 260*a* and 260*b*. In addition, the uniformity of the plating thickness can also be insured.

The fastening of the FPC 270*a* and 270*b* to the housings 240*a* and 240*b* may be accomplished by bonding using an appropriate adhesive agent such as an epoxy type adhesive or a modified acrylic type adhesive commercially marketed by Du Pont under the trademark of Pyralax. Alternatively, fastening can also easily be accomplished in a short time by aligning the FPC 270*a* and 270*b* with bosses or grooves (not shown) formed in the housings 240*a* and 240*b*, and bonding the FPC's by the application of heat and pressure.

As described hereinbefore, the FPCs 270*a*, 270*b* having conductor patterns 250*a*, 250*b* on the surfaces thereof are bent in three dimensions before being retained on the housings 240*a*, 240*b* thereby providing contacts having different narrow pitches between the contacts 252*a*, 252*b* and the solder connection sections 251*a*, 251*b*. Advantages of the present invention include technical merits such as providing very narrow pitch contacts which are impossible to achieve by conventional stamping techniques, achieving low profile and miniaturization occupying minimum space (real estate) on the circuit board by retaining the FPCs on the coplanarity of the solder connection sections, and high dimensional accuracy of the contacts (conductor patterns) as well as economical merits of reducing overall production cost by eliminating the need for a stamping die for making the contacts and a contact insertion machine.

The preferred embodiments of the board connector of the present invention have been described in detail with reference to the attached FIGS. 1 through 13. However, the present invention is not limited to such embodiments; it will be readily apparent to a person skilled in the art that various modifications and changes are possible in accordance with intended uses. For example, the respective contacts do not have to be SMT contacts; the contacts could also be contacts with solder tails which are connected by insertion into through-holes formed in the boards.

Furthermore, the board connectors in the above embodiments are of the horizontal attachment type, with two boards installed parallel to each other. However, the board connectors of the present invention may also be of the vertical attachment type, with the two boards installed in a perpendicular arrangement. Furthermore, two elastomer connecting members are used for board connectors with two rows of contacts. However, it would also be possible to use only a single elastomer connecting member, which can be interposed for the connection of one row of contacts on each housing, with the remaining row of contacts on each housing being directly connected to the corresponding contacts on the other housing. In this case, the contact pressure for the remaining contacts is obtained from the elasticity of the single elastomer connecting member via the second housing. It would also be possible to form the contacts on one of the two connectors by MID, and to form the contacts on the other connector as an FPC conductive pattern. Especially in cases where the contacts on the second connector are formed by MID and the contacts on the first connector are formed as an FPC conductive pattern, manufacture is easy and the manufacturing cost is low.

In the board connector of the present invention, as is clear from the above description, a first connector and a second connector, each of which has a plurality of aligned contacts, are respectively connected by soldering to conductive pads formed on the inside surfaces of first and second boards that are to be connected to each other. Next, the two connectors are connected to each other with elastomer connecting members interposed between the contact sections of the contacts of the connectors. Since a wiping action is created between the contact sections of the contacts and the elastomer connecting members, highly reliable electrical connections are attained. Furthermore, since the elastomer connecting members are not connected by direct compression between the boards, any compressive force in the board connector of the present invention acts in the direction parallel to the surfaces of the boards, so that no reduction in the reliability of the connections due to warping of the boards take place. In additions the boards can be connected to each other in an extremely low configuration. Accordingly, the board connector of the present invention has various conspicuous practical merits not found in conventional board connectors: e.g., the density of electronic devices can be increased, etc. Furthermore, if plating layers or FPC conductive patterns formed on the housings are used as contacts; conductive patterns with a three-dimensional structure can be formed more easily than those in cases where conventional metal contacts are used. Accordingly, a narrower pitch, a much lower height and better flatness of the parts connected to the boards can be obtained. Furthermore, lower-cost connectors can be obtained as a result of the reduction in the number of processes required. Especially in the case of narrow-pitch mounting, the height of the parts connected to the boards depends only on the height of the housings, so that an extremely low height is obtained.

We claim:

1. A circuit board connector for electrically connecting conductive pads of circuit boards, comprising:

a first dielectric housing having a recess extending along the length thereof, first electrical contacts on said first dielectric housing having first contact sections for electrical connections to the conductive pads of a first circuit board and second contact sections extending along opposing walls of said recess;

a second dielectric housing profiled to fit within said recess, second electrical contacts on said second dielectric housing having third contact sections for electrical connection to the conductive pads of a second circuit board and fourth contact sections extending along side surfaces of said second dielectric housing opposite the walls of said recess; and elastomer connecting members disposed in said recess between the side surfaces of said second dielectric housing and the walls of said recess electrically connecting the second contact sections and the fourth contact sections.

2. A circuit board connector as claimed in claim 1, wherein the first electrical contacts or the second electrical contacts are in the form of plated metal on the first or second dielectric housing.

3. A circuit board connector as claimed in claim 1, wherein the first and second electrical contacts are in the form of plated metal on the first and second dielectric housings.

4. A circuit board connector as claimed in claim 1, wherein the first electrical contacts or the second electrical contacts comprise conductive patterns on a flexible printed circuit secured along outer surfaces of the corresponding housing thereof.

5. A circuit board connector as claimed in claim 1, wherein the first and second electrical contacts comprise conductive patterns on a flexible printed circuit secured along outer surfaces of the corresponding housings thereof.

6. A circuit board connector as claimed in claim 1, wherein the first electrical contacts comprise conductive patterns on a flexible printed circuit secured on outer surfaces of said first dielectric housing and the second electrical contacts are in the form of plated metal on an outer surface of said second dielectric housing.

* * * * *